US006948667B2

(12) United States Patent
Eichendorf

(10) Patent No.: US 6,948,667 B2
(45) Date of Patent: Sep. 27, 2005

(54) FUEL INJECTOR

(75) Inventor: Andreas Eichendorf, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 10/399,746

(22) PCT Filed: May 25, 2002

(86) PCT No.: PCT/DE02/01926

§ 371 (c)(1),
(2), (4) Date: Aug. 13, 2003

(87) PCT Pub. No.: WO03/018992

PCT Pub. Date: Mar. 6, 2003

(65) Prior Publication Data

US 2004/0031862 A1 Feb. 19, 2004

(30) Foreign Application Priority Data

Aug. 20, 2001 (DE) ..... 101 40 799

(51) Int. Cl.[7] ..... F02M 51/00

(52) U.S. Cl. ..... 239/585.1; 239/585.4; 239/533.2

(58) Field of Search ..... 239/585.1, 585.4, 239/533.2

(56) References Cited

U.S. PATENT DOCUMENTS 4,732,327 A * 3/1988 Aichele et al. ..... 239/463
5,875,764 A * 3/1999 Kappel et al. ..... 123/467
6,148,842 A * 11/2000 Kappel et al. ..... 137/79
6,435,430 B1 * 8/2002 Ruehle et al. ..... 239/585.4
6,530,555 B1 * 3/2003 Stoecklein et al. ..... 251/57
6,739,528 B2 * 5/2004 Lorraine et al. ..... 239/585.1
6,789,743 B2 * 9/2004 Baranowski et al. ..... 239/124

FOREIGN PATENT DOCUMENTS

| | | | | |
|---|---|---|---|---|
| DE | 43 06 073 | | 6/1994 | |
| DE | 43 06 072 | | 9/1994 | |
| DE | 4306072 | A1 * | 9/1994 | ..... B05B/1/30 |
| DE | 195 00 706 | | 7/1996 | |
| DE | 197 44 235 | | 4/1999 | |
| DE | 1994054 | A1 * | 3/2001 | ..... F02M/51/06 |
| DE | 199 40 054 | | 3/2001 | |
| DE | 100 06 319 | | 8/2001 | |
| EP | 0477400 | A1 * | 9/1990 | ..... H01L/41/09 |
| EP | 0 477 400 | | 4/1992 | |
| WO | WO 02 31344 | | 4/2002 | |

* cited by examiner

*Primary Examiner*—David A. Scherbel
*Assistant Examiner*—James S. Hogan
(74) *Attorney, Agent, or Firm*—Kenyon & Kenyon

(57) ABSTRACT

A fuel injector, in particular a fuel injector for fuel-injection systems of internal combustion engines, having a piezoelectric or magnetostrictive actuator, has a coupler with a master piston and a slave piston which are connected to a pressure chamber. The pressure chamber is filled with an hydraulic fluid, and a coupler spring presses apart the master piston and the slave piston. The pressure chamber is connected to an actuator chamber via a check valve whose blocking direction faces the pressure chamber. The actuator chamber is sealed from a fuel chamber via a movable membrane.

11 Claims, 1 Drawing Sheet

FUEL INJECTOR

FIELD OF THE INVENTION

The present invention is directed to a fuel injector.

BACKGROUND INFORMATION

European Published Patent Application No. 0 477 400 describes an hydraulic coupler for a piezoelectric actuator in which the actuator transmits a lifting force to a master piston. The master piston is in force-locking connection to a guide cylinder for a slave piston. The slave piston, the guide cylinder and the master piston sealing the guide cylinder form an hydraulic chamber. A spring which presses apart the master piston and the slave piston is situated in the hydraulic chamber. Arranged around an end section of the guide cylinder and the slave piston is a rubber sleeve which seals a holding chamber for a viscous hydraulic fluid from a fuel chamber. The viscosity of the hydraulic fluid is adapted to the ring gap between the slave piston and the guide cylinder.

The slave piston mechanically transmits a lifting movement to a valve needle, for instance. In response to the actuator transmitting a lifting movement to the master piston and the guide cylinder, this lifting movement is transmitted to the slave piston by the pressure of the hydraulic fluid in the hydraulic chamber, because the hydraulic fluid in the hydraulic chamber is not compressible and during the short duration of a lift only a small portion of the hydraulic fluid is able to escape through the ring gap into the storage chamber formed by the rubber sleeve. In the rest phase, when the actuator does not exert any pressure on the master piston, the spring pushes the slave piston out of the guide cylinder and, due to the generated vacuum pressure, the hydraulic fluid enters the hydraulic chamber via the ring gap and refills it. In this way, the coupler automatically adapts to longitudinal expansions and pressure-related extensions of a fuel injector.

What is disadvantageous in the related art is that the sealing provided by a rubber sleeve, which is usually pressed against the end section of the guide cylinder and the slave piston by two clamping rings, is unsatisfactory in the long term. It is possible that the highly viscous hydraulic fluid and the fuel mix and the coupler breaks down. When fuel, such as gasoline, reaches the interior of the coupler, a loss of function may occur since this fluid, due to the low viscosity of gasoline, may flow too rapidly through the ring gap and no pressure is able to be generated in the pressure chamber during the lift duration.

The known related art also does not offer a solution for protecting the piezoactuator from contact with fuel, especially gasoline.

German Patent No. 43 06 073 describes a fuel injector having a piezoactuator which is to connected to a pressure piston having a large surface. This pressure piston is prestressed with respect to the piezoelectric actuator by a disk spring which is braced against the valve body of a fuel injector. The pressure piston is guided in a bore of the valve body and has a central bore hole in which a slave piston is guided, the slave piston being connected to a valve needle. Situated in the bore of the pressure piston, between the base of the bore and the slave piston, is a spring which provides an initial stress to the slave piston in the direction of a valve seat and pushes it out of the bore. The fuel injector has a valve needle that opens to the inside. A pressure chamber is located between the fuel injector valve body and the pressure piston and the opposite side of the slave piston. The pressure chamber is in connection with the actuator chamber via the ring gap between the slave piston and the pressure piston, the bore in the pressure piston and a connecting bore. The actuator chamber is used as a holding chamber for an hydraulic fluid. When the piezoactuator is actuated in response to a voltage being applied, the pressure piston is moved in the direction of the valve seat. Due to the increased pressure of the hydraulic fluid in the pressure chamber, the slave piston is pressed into the bore into the pressure piston, counter to the pressure piston's direction of movement, thereby lifting a valve needle off from the valve seat.

Disadvantageous in this known related art is that it does not provide a solution for a fuel injector opening toward the outside. Furthernore, it is disadvantageous that no devices for the rapid refilling of the pressure chamber following its return to the rest position are provided. 30 Finally, the design consists of a plurality of parts and is complicated since a pressure piston which is guided in a precise bore in the fuel injector, in turn requires a precisely worked bore for the slave piston.

SUMMARY OF THE INVENTION

In contrast, the fuel injector according to the present invention has the advantage over the related art that the moveable membrane makes it possible to achieve a reliable sealing of the actuator chamber from the fuel chamber. Furthermore it is advantageous that, because of the check valve, a rapid refilling of the pressure chamber takes place following the return of the piezoactuator to its original position and the return of the slave piston to its original position and the thus produced volume enlargement of the fuel chamber. The generated vacuum pressure opens the check valve and the hydraulic fluid rapidly continues to flow into the pressure chamber. The moveable membrane is advantageously able to be sealed in a durable manner if it is, for example, a thin metal membrane which may be affixed by welded seams both on the slave piston and also on the valve body of a fuel injector. The sealing lines themselves, thus, are no flexible sealing lines and are able to be permanently sealed for the lifetime. The required flexibility is provided solely by the elasticity of the membrane. In this context it is particularly advantageous that the membrane does not stand in the way of the mobility of the slave piston since the pressure prevailing in the actuator chamber and in the fuel chamber is the same, and the membrane, due to its deformability, moves into position in such a way that it itself need not absorb any forces arising from occurring pressure differences. Therefore, the piezoactuator is reliably protected from contact with the fuel and at the same time may be cooled by the highly viscous hydraulic fluid. It is also possible to protect it from wear caused by contact friction with the housing of the fuel injector.

Both the slave piston and the master piston advantageously may be formed as deep-drawn parts from sheet metal.

By using a separate hydraulic fluid that is highly viscous, the viscosity may be adapted to the expected ring gaps between a guide cylinder and the master piston or the slave piston. Thus, the use of deep-drawn parts able to be produced in a cost-effective manner from sheet metal, which do not allow any very narrow tolerances, is possible.

In one advantageous embodiment, at least a partial section of the ring gap between the master piston or the slave piston and a guide cylinder in the installation position of the fuel injector is located in the rise direction of possible gas bubbles at the highest point of the pressure chamber.

Since, for installation-related reasons, it is impossible to keep the pressure chamber of a coupler according to the present invention completely free of gas bubbles during the production of the fuel injector, it is vitally important that gas bubbles present in the pressure chamber are able to escape quickly. Because of the check valve, the hydraulic fluid can escape from the pressure chamber during operation via the ring gap only during the brief lifting phases. When at least a partial section of such a ring gap is located at the highest point in the installation position, the pressure chamber is reliably emptied of all gas bubble over the service life of the fuel injector. By locating the actuator and, thus, the actuator chamber above the coupler in the normal installation position, even the hydraulic fluid that continues to flow following a lift because of the check valve is free of gas bubbles. A reduction in the valve-needle lift by the undesired compression of a gas bubble in the pressure chamber is not possible. Remaining gas bubbles will eventually collect in the upper region of the actuator chamber and be compressed to the extent of the pressure that equally prevails in the actuator chamber and the fuel chamber. The gas bubbles, which are unavoidable during filling in the manufacture of a fuel injector, thereby are unable to cause losses of function or malfunctions.

In one advantageous embodiment, the slave piston is sealingly connected to the guide cylinder in a force-locking manner.

A simple component results due to the fact that, for instance, the guide cylinder is made from a deep-drawn sheet metal part or a tube section which is sealingly joined to the slave piston by welding, the master piston being guided in this cup-type component.

Alternatively it is possible to provide different diameters for the master piston and the slave piston and, thus, different effective surfaces.

This makes it possible to step up the travel, and the small lift of a piezoactuator is able to be translated into a larger stroke.

In one advantageous embodiment, the one-way valve is a ball check valve whose valve seat is formed on the master piston.

A ball check valve may be produced in a cost-effective manner and, having a small size, is easy to accommodate in the pressure chamber.

In an advantageous embodiment, a silicon oil is used as the hydraulic fluid. An actuator spring may be embodied as a helical spring and surround the hydraulic coupler.

Thus, the required presstressing force on the actuator may be achieved by a compact system.

The membrane advantageously has a wave-shaped contour in a radial section.

In this way, if the membrane is located in a radial plane relative to an axis of symmetry of a fuel injector, high axial deformability of the membrane is produced. In the case of pressure differences between the actuator chamber and the fuel chamber, the membrane deforms in the axial direction along its radial section until pressure parity is established. In this way it also adapts to the movement of the slave piston to which it is sealingly connected by force-locking.

BRIEF DESCRIPTION OF THE DRAWING

The FIGURE shows a schematic section through an exemplary embodiment of a fuel injector configured according to the present invention, in the region of the actuator and the coupler.

DETAILED DESCRIPTION

Figure 1:
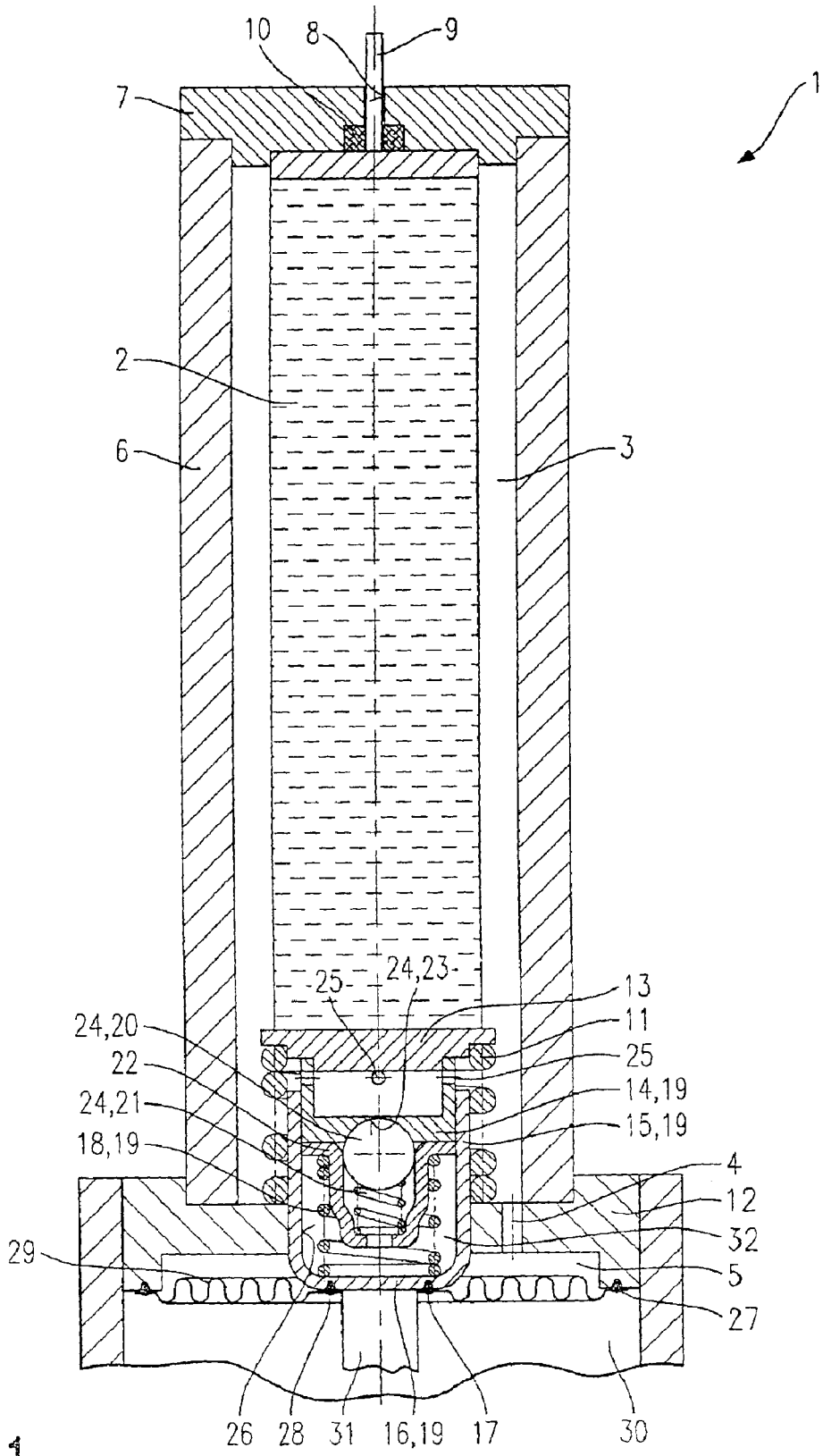

FIGURE schematically shows a cut-away portion of a fuel injector 1, an area of a piezoelectric or magnetostrictive actuator 2 being represented and an actuator chamber 3 which is connected to a lower actuator chamber 5 via a connecting bore 4. Actuator 2 is located in an actuator-chamber housing 6 which is bounded by a sealing plate 7. Electrical connections 9 are guided through a bore 8 in sealing plate 7 and sealed by an O-ring 10. Actuator 1 is activated by an electric voltage via these electrical connections 9. An actuator spring 11 is braced against an intermediate plate 12 and presses an actuator head 13 against actuator 2, so that actuator 2 comes to rest against sealing plate 7. Resting against actuator head 13 is a master piston 14 which is guided in a guide cylinder 15. Guide cylinder 15 is sealingly connected by a welded seam 17 to a slave piston 16 in a force-locking manner. A coupler spring 18 imparts an initial stress to master piston 14, which is intended to drive master piston 14 out of guide cylinder 15. Master piston 14, guide cylinder 15, slave piston 16 and coupler spring 18 form coupler 19. Inside coupler 19 is a check ball 20 which is pressed against a valve-sealing seat 23 into master piston 14 via a kick-back spring 21 and a guide sleeve 22. Check ball 20, kick-back spring 21 and sealing seat 23 form a check valve 24. Via inflow bores 25, the hydraulic fluid is able to flow from the upper actuator chamber 3 to valve-sealing seat 23 of check valve 24. Coupler 19 with its guide cylinder 15 is guided in a bore 26 of intermediate plate 12. A membrane 29 is sealingly connected to intermediate disk 12 via an outer welding seam 27, and the same membrane 29 is sealingly connected to slave piston 16 via an inner welded seam 28.

Membrane 29 separates a fuel chamber 30 from a lower actuator chamber 5. Since lower actuator chamber 5 is connected to upper actuator chamber 3 via connecting bore 4, the pressure prevailing in upper actuator chamber 3, lower actuator chamber 5 and fuel chamber 30 is the same, membrane 29 deforming until the pressure has been equalized. Membrane 29 also follows the movement of slave piston 16, and in the process sections of membrane 29 located radially further outward execute a movement in the opposite direction, so that the pressure compensation between lower actuator chamber 5 and fuel chamber 30 during a lifting movement of slave piston 16 is maintained as well. Membrane 29 does not, or only to a negligible extent, hinder or influence the lifting movement of slave piston 16. Slave piston 16 transmits a possible lifling movement to a valve needle 31.

If a voltage is applied to actuator 2 via electric line 9, actuator 2 exerts a lifting movement on actuator head 13 which is transmitted further to master piston 14 of coupler 19. Master piston 14 is pressed into the interior of guide cylinder 15, which is integrally formed with slave piston 16 as a one-piece deep-drawn part. The hydraulic fluid inside a pressure chamber 32 formed by slave piston 16, guide cylinder 15 and master piston 14, as a highly viscous fluid, such as silicon oil, is nearly incompressible. Thus, the pressure in pressure chamber 32 rises rapidly, causing check ball 20 to be pressed into sealing seat 23 and guide cylinder 15 with slave piston 16 to move in bore 26 of intermediate plate 12 in the direction of valve needle 31 and to exert a lifting force upon this valve needle 31. Because of the ring gap necessarily existing between master piston 14 and guide cylinder 15, only a small quantity of silicon oil is able to escape into upper pressure chamber 3, due to the high viscosity of the silicon oil, so that valve needle 31 of fuel injector 1 opens. Once the voltage drops at actuator 2, actuator 2 is pressed back to its starting position by actuator spring 11 via actuator head 13. Valve needle 31 also returns to its original position. Coupler spring 18 presses guide cylinder 15 and slave piston 16 against valve needle 13 up to the stop, and master piston 14 against actuator head 13 up to the stop. Since the hydraulic fluid is unable to continue flowing quickly enough into pressure chamber 32 via the ring gap between master piston 14 and guide cylinder 15, a vacuum pressure is generated in pressure chamber 32 due to the force of coupler spring 18, and check ball 20 is lifted off from sealing seat 23. Silicon oil can flow via inflow bores 25 and sealing seat 23 from actuator chamber 3 into pressure chamber 32 until there is no longer any vacuum pressure and kickback spring 21 once again presses check ball 20 into sealing seat 23. Coupler 19, thus, automatically adjusts to longitudinal changes between the rest position of valve needle 31 and actuator head 13.

The silicon oil's properties are advantageously able to be optimized for the coupler and the use in actuator chamber 3. By adjusting an appropriate viscosity, for instance, it is possible to design the components of master piston 14, guide cylinder 15 and slave piston 16 as inexpensively produced deep-drawn sheet-metal parts which call for relatively large gap dimensions. The described embodiment of a fuel injector 1 according to the present invention also makes it possible to reliably seal actuator 2 from fuel chamber 30 since sealing membrane 29 is not exposed to any pressure forces. By the also shown arrangement of master piston 14 in an installation position of fuel injector 1 such that the unavoidable ring gap between master piston 14 and guide cylinder 15 is at least in part located in the upper region of pressure chamber 32, in the rise direction of possible gas bubbles, it is possible for pressure chamber 32 to remain free of gas bubbles in long-term operation und for fuel injector 1 to function perfectly. Gas bubbles accumulate in pressure 32 in the upper region and in the case of a lifting of actuator 2 the gas bubbles are first pressed out through the ring gap. However, in upper actuator chamber 3 the gas bubbles collect in the vicinity of sealing plate 7 where they do not adversely affect the performance reliability of fuel injector 1. As a result, the hydraulic fluid that continues flowing via sealing seat 23 is free of gas bubbles. Within a short time, no gas bubbles are left in pressure chamber 32.

Moreover, it is advantageous that the silicon oil has a damping effect not only on actuator 2 but also on all other movable parts. Due to the high activation rate of fuel injectors 1 that modem internal combustion engines require, oscillations may occur which are effectively damped.

What is claimed is:

1. A fuel injector, comprising:

a hydraulic coupler including a master piston and a slave piston that are connected to a pressure chamber, the pressure chamber being capable of containing hydraulic fluid;

a valve needle including a valve-closure member formed thereon;

a valve seat surface;

one of a piezoelectric actuator and a magnetostrictive actuator that, via the hydraulic coupler, actuates the valve-closure member, the valve-closure member cooperating with the valve-seat surface to form a valve-sealing seat;

a coupler spring pressing apart the master piston and the slave piston;

a check valve via which the pressure chamber is connected to an actuator chamber, a blocking direction of the check valve facing the pressure chamber; and a movable membrane for sealing the actuator chamber from a fuel chamber, wherein at least one of:

the slave piston is a deep-drawn part made from sheet metal, and the master piston is a deep-drawn part made from sheet metal.

2. The fuel injector as recited in claim 1, wherein:

the fuel injector is for a fuel-injection system of an internal combustion engine.

3. The fuel injector as recited in claim 1, further comprising:

a guide cylinder, wherein:

at least a partial section of a ring gap between one of the master piston and the slave piston and the guide cylinder in an installation position of the fuel injector is situated in a rise direction of possible gas bubbles at a highest. point of the pressure chamber.

4. The fuel injector as recited in claim 1, wherein:

the check valve includes a ball check valve.

5. The fuel injector as recited in claim 4, wherein:

a valve seat of the ball check valve is formed on the master piston.

6. The fuel injector as recited in claim 1, wherein:

the hydraulic fluid includes a silicon oil.

7. The fuel injector as recited in claim 1, wherein:

the movable membrane has a wave-shaped contour in a radial section.

8. A fuel injector, comprising:

a hydraulic coupler including a master piston and a slave piston that are connected to a pressure chamber, the pressure chamber being capable of containing hydraulic fluid;

a valve needle including a valve-closure member formed thereon;

a valve seat surface;

one of a piezoelectric actuator and a magnetostrictive actuator that, via the hydraulic coupler, actuates the valve-closure member, the valve-closure member cooperating with the valve-seat surface to form a valve-sealing seat;

a coupler spring pressing apart the master piston and the slave piston;

a check valve via which the pressure chamber is connected to an actuator chamber, a blocking direction of the check valve facing the pressure chamber;

a movable membrane for sealing the actuator chamber from a fuel chamber; and a guide cylinder, wherein:

the slave piston is sealingly connected to the guide cylinder by force-locking, and at least a partial section of a ring gap between one of the master piston and the slave piston and the guide cylinder in an installation position of the fuel injector is situated in a rise direction of possible gas bubbles at a highest point of the pressure chamber.

9. A fuel injector, comprising:

a hydraulic coupler including a master piston and a slave piston that are connected to a pressure chamber, the pressure chamber being capable of containing hydraulic fluid;

a valve needle including a valve-closure member formed thereon;

a valve seat surface;

one of a piezoelectric actuator and a magnetostrictive actuator that, via the hydraulic coupler, actuates the valve-closure member, the valve-closure member cooperating with the valve-seat surface to form a valve-sealing seat;

a coupler spring pressing apart the master piston and the slave piston;

a check valve via which the pressure chamber is connected to an actuator chamber, a blocking direction of the check valve facing the pressure chamber; and a movable membrane for sealing the actuator chamber from a fuel chamber, wherein:

the master piston and the slave piston have surfaces that differ in their effectiveness.

10. A fuel injector, comprising:

a hydraulic coupler including a master piston and a slave piston that are connected to a pressure chamber, the pressure chamber being capable of containing hydraulic fluid;

a valve needle including a valve-closure member formed thereon;

a valve seat surface;

one of a piezoelectric actuator and a magnetostrictive actuator that, via the hydraulic coupler, actuates the valve-closure member, the valve-closure member cooperating with the valve-seat surface to form a valve-sealing seat;

a coupler spring pressing apart the master piston and the slave piston;

a check valve via which the pressure chamber is connected to an actuator chamber, a blocking direction of the check valve facing the pressure chamber;

a movable membrane for sealing the actuator chamber from a fuel chamber; and an actuator spring that exerts an initial stress on the one of the piezoelectric actuator and the magnetostrictive actuator and that surrounds the hydraulic coupler.

11. The fuel injector as recited in claim 10, wherein:

the actuator spring includes a helical spring.

* * * * *

UNITED STATES PATENT AND TRADEMARK OFFICE

CERTIFICATE OF CORRECTION

PATENT NO. : 6,948,667 B2
APPLICATION NO. : 10/399746
DATED : September 27, 2005
INVENTOR(S) : Andres Eichendorf It is certified that error appears in the above-identified patent and that said Letters Patent is hereby corrected as shown below:

Column 2, line 16 change “are provided. 30” to --are provided.--

Signed and Sealed this

First Day of May, 2007

JON W. DUDAS
*Director of the United States Patent and Trademark Office*